United States Patent [19]

Kassner

[11] 4,166,990

[45] Sep. 4, 1979

[54] CORE/COIL ASSEMBLY FOR USE IN SUPERCONDUCTING MAGNETS AND METHOD FOR ASSEMBLING THE SAME

[75] Inventor: David A. Kassner, Patchogue, N.Y.

[73] Assignee: The United States of America as represented by the United States Department of Energy, Washington, D.C.

[21] Appl. No.: 824,192

[22] Filed: Aug. 12, 1977

[51] Int. Cl.[2] ..... H01F 1/00; H01F 7/00; H01F 7/22

[52] U.S. Cl. ..... 335/216; 29/606; 174/15 S

[58] Field of Search ..... 335/216; 174/15 S; 336/155, 55; 29/606

[56] References Cited

PUBLICATIONS

A. D. McInturff et al., Isabelle Ring Magnets, Paper Presented at Applied Superconductivity Conference, Standford University, Palo Alto, California, 8/17-20/76.

W. B. Sampson, Superconducting Magnets for Isabelle, Invited Paper, All Union National Conference on Particle Accelerators, Dubna, USSR, 10/5-7/76.

W. B. Sampson et al., The Magnetic and Thermal Stability of Superconducting Accelerator Magnets, Proceeding of the IXth International Conf. on High Energy Accelerators, SLAC, Stanford, Calif., (1974).

A. D. McInturff et al., Full-Scale ISA Dipoles, IEEE Transaction on Nuclear Science, vol. NS-22, No. 3, Jun. 1975.

J. Bilan et al., Construction of a Prototype Superconducting Quadrapole Magnet for a High-Luminosity Insertion at the CERN Intersecting Storage Rings, 10/5/76.

*Primary Examiner*—Harold Broome

*Attorney, Agent, or Firm*—Dean E. Carlson; Robert H. Whisker; Leonard Belkin

[57] ABSTRACT

A core/coil assembly for use in a superconducting magnet of the focusing or bending type used in syncronous particle accelerators comprising a coil assembly contained within an axial bore of the stacked, washer type, carbon steel laminations which comprise the magnet core assembly, and forming an interference fit with said laminations at the operating temperature of said magnet. Also a method for making such core/coil assemblies comprising the steps of cooling the coil assembly to cryogenic temperatures and drawing it rapidly upwards into the bore of said stacked laminations.

11 Claims, 5 Drawing Figures

CORE/COIL ASSEMBLY FOR USE IN SUPERCONDUCTING MAGNETS AND METHOD FOR ASSEMBLING THE SAME

BACKGROUND OF THE INVENTION

This invention was made during the course of, or under a contract with, the United States Energy Research and Development Administration.

This invention relates to an improved mechanical structure for superconducting magnets of the focusing or bending type and to a novel method for assembling such magnets.

When the coil assemblies of magnets of this type are energized they are subjected to large radial magnetic forces. One way to restrain the coil against such forces is to use the carbon steel laminations of the magnet core. This necessitates that the laminations be in intimate contact with the outside surface of the coil assemblies at operating temperature. However, the integrated thermal contraction of a superconducting coil assembly from ambient to operating temperature (approx. 4.2° K.) is greater than, or at best essentially equal to, the corresponding contraction of the laminations. Therefore, in order that the laminations continue to exert a radially compressive load on the coil assembly the core/coil assembly must be manufactured with a substantial interference fit at room temperature. In one prior form of magnet of this type this has been done by splitting the core stack into two sections on a horizontal plane. The coil assembly is cooled to a cryogenic temperature and placed between the sections of the core stack. The two sections are then rapidly welded together using stainless steel tie bars.

This design and method of assembly have many inherent disadvantages. The spaces between the tie bars and the minimum clearance, needed for assembly, between the protruding circumferential tie bars and the ID of the helium containment vessel represents excess helium capacity. Since it appears that only helium in the immediate vicinity of the coil is effective during a magnet quench this helium capacity is wasted. Further, in such a design, there is no single member providing structural rigidity. Also, stresses induced during welding may be relaxed during cool down resulting in a loss of dimensional accuracy. Finally, because of the need to complete assembly before the coil assembly warms significantly the assembly method used in the prior art requires a large crew of skilled welders. Other prior forms of magnets of this type are similarly complex in structure and assembly.

SUMMARY OF THE INVENTION

This invention in a first preferred embodiment substantially overcomes the problems described above by means of an assembly for use in a superconducting magnet of the focusing or bending type used in synchronous accelerators comprising a magnet tube, having substantial longitudinal rigidity, a core stack having an axial bore, said stack further comprising a plurality of carbon steel washer type laminations having a shape substantially conforming to the cross-section of said magnet tube, restraining devices for holding said laminations as a compressed stack within said magnet tube, so as to form a core assembly and a coil assembly within said bore forming an interference fit with said core assembly at the operating temperature of said magnet. By washer type laminations herein is meant one piece laminations thin enough to reduce eddy current losses to an acceptable level and having a circular hole formed approximately in the center thereof, all such laminations having essentially the same dimensions so that they may be stacked to form a straight core stack having a straight bore.

Previously, magnets similar to the above-described magnet, had been considered infeasible because of the need for an interference fit between the core stack and the coil assembly. It was not considered practical to heat the core assembly substantially in order to insert the coil assembly because the necessary temperature would damage the coil assembly. Cooling the coil assembly only provides in the order of 5–10 thousandths of an inch clearance at most. This amount of clearance previously was not considered adequate to assemble magnets of this type which may have a length greater than four meters.

The subject invention overcomes these problems in a second preferred embodiment by means of a novel method, comprising the steps of placing said coil assembly below said core assembly, the latter in a first region, maintained at first, elevated, temperature, said first temperature being low enough to avoid damage to the coil assembly, placing said coil assembly below said core assembly in a second region maintained at a second depressed temperature, said coil assembly being axially aligned with said core assembly, then allowing a sufficient length of time to permit said coil assembly to reach sufficient length of time to permit said coil assembly to reach sufficient dimensional contraction to produce a dimensional clearance between the periphery of said coil assembly and the interior of said core assembly while ensuring that said coil assembly is free of ice, then pulling said coil assembly axially upwards into said core assembly in said first region within a time span sufficiently short to complete the movement before a significant amount of ice forms on said coil assembly and before the assemblies contact each other as a result of dimensional change, then allowing said assemblies to equalize in temperature while they are held in proper alignment so as to form an interference fit between said assemblies. The first and second temperature are selected, within the limitations described above, to provide the aforementioned dimensional clearance. The first temperature may be ambient.

By pulling axially upwards herein is meant applying an upwards force which resolves essentially along the common axis of the aligned assemblies in such a manner that the coil assembly has sufficient freedom of motion that it will align itself as it is pulled into the core assembly.

In a third preferred embodiment of the subject invention the assembly of the core/coil assembly is carried out using an apparatus comprising, a means for cooling a coil assembly to a first temperature low enough to obtain sufficient contraction for assembly of the coil assembly with a core assembly, means for aligning the core assembly above the coil assembly along a verticle axis, and means for axially pulling said coil assembly upwards into the bore of the core assembly and for holding the coil assembly in place while allowing the temperatures to equalize whereby an interference fit is formed between the assemblies.

In a fourth preferred embodiment of the subject invention the assembly of the core/coil assembly further comprises the assembly of the core stack using an apparatus comprising, a fixture to support and align the laminations during stacking, a mandrel within the bore formed by the stacked laminations so as to support the core stack when it is being moved, means for compressing said laminations after they have been assembled on the mandrel so as to form the core stack, and means for holding the core stack in compression after the compression means have been disconnected until the core stack is assembled with the magnet tube.

Thus, the method of the subject invention overcomes the problems of the prior art by rapid assembly techniques which avoid ice formation and are completed before said coil assembly expands significantly and by pulling said coil assembly axially upwards which facilitates rapid assembly and allows the coil assembly to be self-aligning during insertion.

A core/coil assembly as described above would be incorporated in a superconducting magnet by attaching end caps to each end of the magnet tube to form a closed containment vessel. Penetrations are provided in said end caps for introducing coolant and electrical connections to the inner magnet structure. In operation the magnet would be insulated and mounted in a vacuum vessel and connection would be made to electrical and coolant services. Means and methods for so using such an assembly are well known or would be obvious to those skilled in the art. Further non-mechanical details of the design and parameters of typical focusing and bending magnets may be found in "Isabelle Ring Magnets"—BNL Report #21708 and "Superconducting Magnets for Isabelle"—BNL Report #21855, available from the National Technical Information Center, U.S. Department of Commerce, 5285 Port Royal Road, Springfield, Va. 22151, which are hereby incorporated by reference.

It is thus a principle object of the invention to provide a component assembly of a superconducting magnet of the focusing or bending type used in synchronous particle accelerators having a minimal helium capacity and improved dimensional stability and which may be assembled more rapidly at a lower cost.

Other objects and advantages will become apparent from the following detailed description.

DETAILED DESCRIPTION OF THE PREFERRED EMBODIMENT

Figure 1:
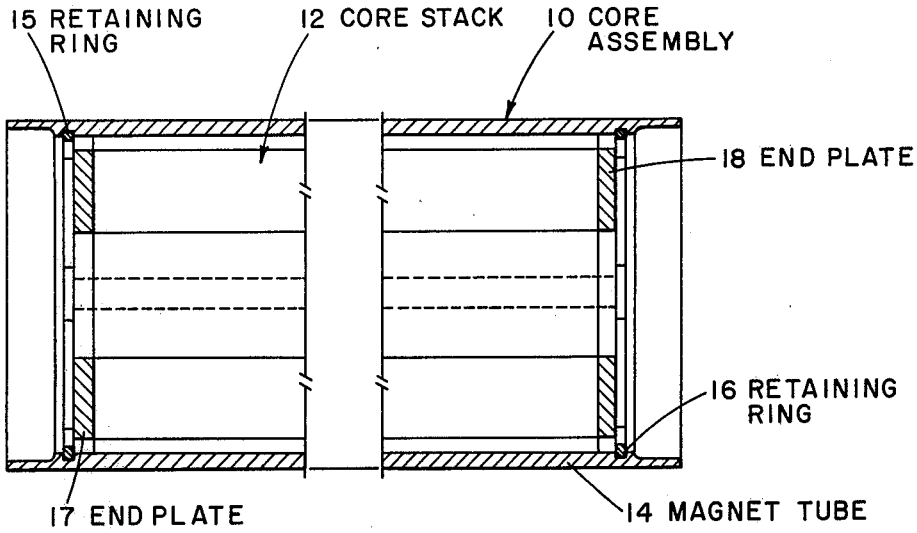
FIG. 1 is a longitudinal cross-section of a core assembly embodying the principles of this invention.

Referring to FIG. 1 core stack (12) is held in compression within stainless steel magnet tube (14) by retaining rings (15,16) and stiff end plates (17,18) to form core assembly (10). A clearance is provided between the stack (12) and the magnet tube (14) at room temperature. The magnet tube (14) contracts faster than the core stack (12) so that when cooled to operating temperature the tube (14) will shrink tightly onto the stack (12) forming a rigid, dimensionally stable structure. Magnet tube (14) has sufficient longitudinal rigidity that when the core assembly (10) is suspended horizontally as in the magnet vacuum vessel the midpoint vertical deflection is small enough that the magnet array may be easily aligned. The retaining rings (15,16) may be welded in place, however; split rings set in grooves are a preferred method.

Figure 2:
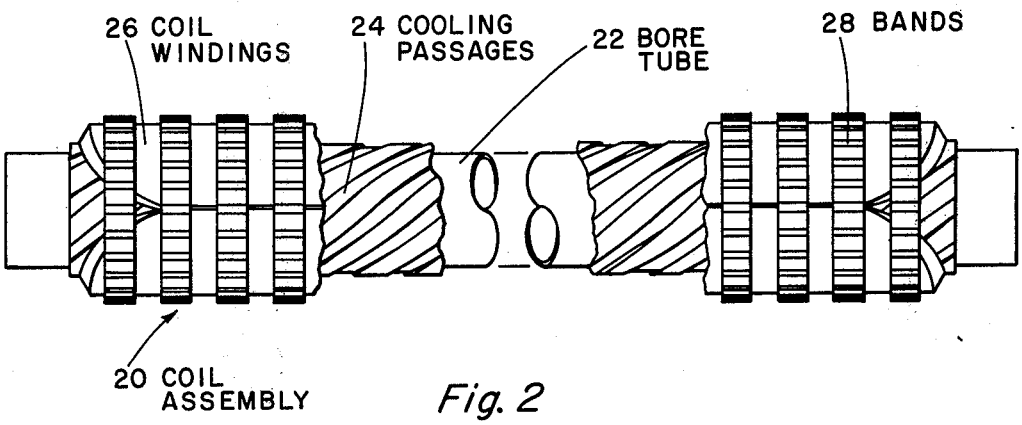
FIG. 2 is a partially cutaway view of the coil assembly.

Referring to FIG. 2 the coil assembly (20) comprises an inner bore tube (22) around which are helical passages (24) for the flow of coolant. The coil windings (26) are held around the bore tube by bands (28). The bands are provided with slots for the flow coolant along the outer surface of coil assembly (20). Such coil assemblies are well known in the art and methods for the proper design and construction of such a coil assembly would be obvious to a person skilled in that art. Details of the design and parameters for such coil assemblies may be found in the publications referenced on Page 4. In the practice of this invention there is a negative clearance between the bore of core assembly (10) and coil assembly (20) when both are at a temperature of approximately 300° K., a clearance when coil assembly (20) is cooled, prior to insertion, and a negative clearance when both are cooled to the operating temperature of the magnet.

Figure 3:
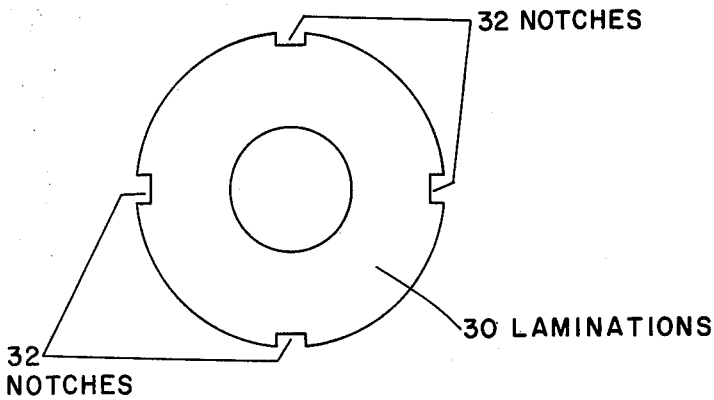
FIG. 3 is a plan view of a lamination.
Figure 4:
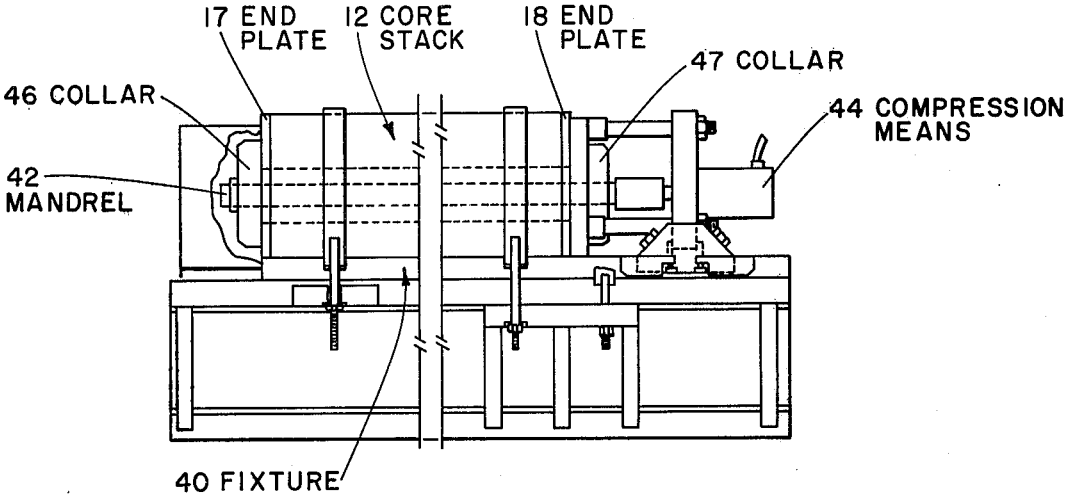
FIG. 4 is a plan view of a partially assembled core stack.

Referring to FIG. 3 the core stack (12) is formed from a plurality of carbon steel laminations (30). The laminations (30) conform to the cross-section of magnet tube (14) except for notches (32). Notches (32) are aligned when laminations (30) are assembled to form core stack (12) so as to form passages between magnet tube (14) and core stack (12) whereby conductors for connecting a plurality of magnets may be passed from magnet to magnet. Referring to FIG. 4 in the assembly of the structure of the subject invention the laminations (30) are aligned and stacked along the top of fixture (40) and end plates (17,18) are placed at the ends of stack (12). Mandrel (42) is inserted in the core. After laminations (30) are aligned on fixture (40) to form core stack (12) they are compressed by compression means (44). Collar (46) is attached to the opposite end of Mandrel (42) to restrain laiminations (30) during compression. After compression a second collar (47) is tightened down on the core stack (12) to maintain compression and compression means (44) is disconnected. Core stack (12) is then strapped to fixture (40) and tipped to a vertical position while so supported. Magnet tube (14) is heated while being held in a vertical position. Core stack (12) is unstrapped from fixture (40) and lifted above then lowered into magnet tube (14). Mandrel (42) holds the core stack (12) straight during this operation. After cooling to ambient temperature retaining rings (15,16) are installed to maintain compression in the core stack (12) and Mandrel (42) is removed.

Figure 5:
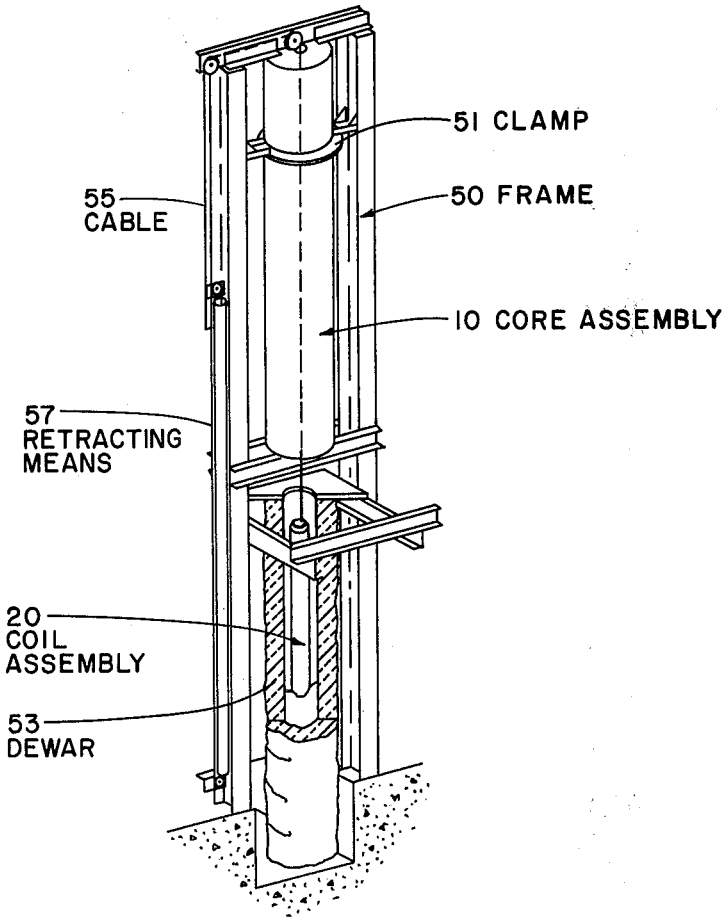
FIG. 5 is an illustration of the apparatus used in the final assembly of the core/coil assembly.

Coil assembly (20) is inserted into core assembly (10) as shown in FIG. 5. Core assembly (10) is held in an elevated vertical position by frame (50) and clamp (51). Coil assembly (20) is placed in liquid nitrogen filled dewar (53) with cable (55) attached and cooled essentially to the temperature of the liquid nitrogen. Dewar (53) and coil assembly (20) are axially aligned below core assembly (10). Cable (55) is passed through the bore of core assembly (10) so that it is essentially co-linear with the axis of core assembly (10) and the other end of cable (55) is attached to retracting means (57). Suitable retracting means would be apparent to a person skilled in the art, however, a pneumatic cylinder of sufficient length driven by a compressed air tank of a size large enough to insure smooth insertion of coil assembly (20) is preferred. Coil assembly (20) is inserted by retracting cable (55). A funnel shaped guide (not shown) may be provided to insure smooth entry of coil assembly (20) into the bore. It is preferred to allow the coil assembly to decelerate for approximately the final foot to avoid damage to the coil assembly due to a sudden stop. It has been found that during cooling any ice on coil assembly (20) will scale off ensuring that coil assembly (20) is free of ice at the start of insertion.

The bore of core stack (10) may be honed, prior to assembly using carbon tetrachloride as a lubricant in order to facilitate assembly.

Magnets incorporating the subject core/coil assembly have been made using the subject method. Such magnets have proven to have improved dimensional stability and accuracy and have been assembled more rapidly and at lower costs than magnets of prior design. The magnets have also shown the unexpected advantages of improved magnetic field accuracy and a reduction in the required number of training cycles. By number of training cycles herein is meant the number of times the magnet must be cycled from low to high current and back before the magnet field reaches maximum strength.

EXAMPLE

In the construction of magnets according to this invention the following parameters and specifications have proven satisfactory:

Core stack (12) is assembled with a compression of approximately 200 lbs. per square inch.

Laminations (30) have a thickness of approximately 0.050 inches.

A clearance of from 0 to 0.007 inches at approximately 300° K., is provided between core stack (12) and magnet tube (14).

There is a negative clearance of approximately 0.013 inches between the bore of core assembly (10) and coil assembly (20) at approximately 300° K., a clearance of approximately 0.007 inches when coil assembly (20) is cooled to approximately 80° K., and a negative clearance of approximately 0.006 inches when both are cooled to approximately 4° K.

There is a clearance of approximately 0.015 inches between mandrel (42) and core stack (12).

Magnet tube (14) is heated to a temperature of approximately 400° K. prior to insertion of core stack (12). Coil assembly (20) is cooled with liquid nitrogen to approximately 80° K. prior to insertion into core assembly (10).

Insertion is carried out in approximately 6 seconds which does not allow time for the formation of frost on coil assembly (20).

What is claimed is:

1. In a superconducting magnet of the focusing or bending type used in synchronous particle accelerators and having a core assembly and a coil assembly the improvement which comprises:
   (a) magnet tube means having substantial longitudinal rigidity;
   (b) core stack means having an axial bore, said stack means further comprising a plurality of carbon steel washer type laminations having a shape substantially conforming to the cross-section of said magnet tube means,
   (c) means for holding said laminations as a compressed stack within said magnet tube means so as to form said core assembly; and,
   (d) said coil assembly within the bore of said core stack means and forming an interference fit with the laminations thereof at the operating temperature of said magnet.

2. The improvement of claim 1 wherein there is sufficient clearance between said coil assembly means and said core stack means to allow the insertion of said coil assembly into the bore of said core stack means when said core stack means is at a first, elevated temperature and said coil assembly is at a second depressed temperature and a negative clearance sufficient to prevent movement in said coil assembly when said magnet is energized when said core stack means and said coil assembly are at the operating temperature of said magnet.

3. The improvement of claim 1 wherein said core stack means forms an interference fit with said magnet tube means at the operating temperature of said magnet so as to form a rigid dimensionally stable structure.

4. The improvement of claim 1 where in said coil assembly further comprises:
   (a) a bore tube means around which are first passages for the flow of coolant;
   (b) a plurality of superconducting coils around said bore tube; and,
   (c) means for holding said coils around said bore tube said means having second passages for the flow of coolant along the surface of said coil assembly.

5. A method for forming an assembly useful in a magnet superconductive at cryogenic temperature, said assembly comprising a cylindrical coil assembly means within and subject to physical restraint by a hollow cylindrical core assembly means during energization at cryogenic temperature, comprising the steps of:
   (a) placing said core assembly means in a first region said first region being maintained at a first, elevated, temperature said first temperature being low enough to avoid damage to said coil assembly means;
   (b) placing said coil assembly means below said core assembly means in a second region maintained at a second depressed temperature said coil assembly means being axially aligned with said core assembly means;
   (c) then allowing a sufficient length of time to permit said coil assembly means to reach sufficient dimensional contraction to produce a dimensional clearance between the periphery of said coil assembly means and the interior of said core assembly means while ensuring that said coil assembly is free of ice;
   (d) then pulling said coil assembly means axially upwards into said core assembly means in said first region within a time span sufficiently short to complete the movement before a significant amount of ice forms on said coil assembly means and before the assemblies contact each other as a result of dimensional changes in said assemblies; and,
   (e) then allowing said assemblies to equalize in temperature while said assemblies are held in the proper alignment so as to form an interference fit between said assemblies.

6. The method of claim 5 wherein said second region consists of the interior volume of an insulated vessel having an upper opening suitable for the rapid upwards withdrawal of said coil assembly means and wherein said second temperature is maintained within said volume by an amount of a liquified gas sufficient to essentially cover said coil assembly means for the aforesaid time span, said liquified gas having a boiling point low enough to achieve the aforesaid sufficient dimensional contraction.

7. The method of claim 6 wherein said liquified gas is nitrogen.

8. The method of claim 6 wherein the relative dimensional characteristics of said assemblies are such as to produce sufficient clearance to allow insertion of said coil assembly means without bending during the aforesaid movement and adequate physical restraint when the magnet is operating at superconducting temperatures.

9. The method of claim 6 wherein the assembly of said core assembly means further comprises the steps of:

(a) aligning and stacking carbon steel washer type laminations between end plate means along a fixture to form a core stack means;

(b) inserting a mandrel means into the bore of said core stack means said mandrel means having a fit to said stack means sufficiently close as to hold said stack means straight while it is being moved;

(c) compressing said core stack means sufficiently that said laminations will not move relative to each other during assembly or operation of said magnet;

(d) attaching collar means for holding said stack means in compression to both ends of said mandrel means;

(e) heating said magnet tube means sufficiently to allow said core stack means to be inserted easily;

(f) inserting said core stack means into said heated magnet tube means;

(g) attaching means for holding said core stack means in compression to said magnet tube means; and, (h) removing said mandrel means.

10. The method of claim 6 wherein the bore of said core assembly means is honed, using carbon tetrachloride as a lubricant, prior to inserting said coil assembly means.

11. The method of claim 6 wherein said coil assembly means is allowed to decelerate for a final portion of its travel sufficient to avoid damage due to suddenly stopping said coil assembly.

* * * * *